US010792536B2

(12) United States Patent
Liu

(10) Patent No.: US 10,792,536 B2
(45) Date of Patent: Oct. 6, 2020

(54) CLIMBING MACHINE

(71) Applicant: Dyaco International Inc., Taipei (TW)

(72) Inventor: Han-Lin Liu, Taipei (TW)

(73) Assignee: Dyaco International Inc., Taipei (TW)

( * ) Notice: Subject to any disclaimer, the term of this patent is extended or adjusted under 35 U.S.C. 154(b) by 63 days.

(21) Appl. No.: 16/164,050

(22) Filed: Oct. 18, 2018

(65) Prior Publication Data

US 2020/0094106 A1 Mar. 26, 2020

(30) Foreign Application Priority Data

Sep. 25, 2018 (TW) ..... 107133633 A

(51) Int. Cl.
*A63B 22/04* (2006.01)
*A63B 21/00* (2006.01)
(Continued)

(52) U.S. Cl.
CPC ..... *A63B 22/04* (2013.01); *A63B 21/00069* (2013.01); *A63B 21/00185* (2013.01);
(Continued)

(58) Field of Classification Search
CPC . A63B 22/04; A63B 21/227; A63B 21/00185; A63B 21/4304; A63B 22/0005; A63B 21/0069; A63B 21/154; A63B 22/0012; A63B 2022/0028; A63B 2022/003; A63B 2022/0033; A63B 2022/0035; A63B 2022/0038; A63B 2022/0041; A63B 2022/0043; A63B 2022/0051; A63B 2022/0071; A63B 2022/0074; A63B 2022/0611; A63B 2022/0635; A63B 2022/067; A63B 2022/0676; A63B 2022/0682; A63B 21/00047; A63B 21/15; A63B 21/151; A63B 21/152; A63B 21/153; A63B 21/155; A63B 21/156; A63B 21/157; A63B 21/22; A63B 21/225; A63B 21/4033; A63B 21/4034; A63B 22/00; A63B 22/0002; A63B 22/0007; A63B 22/001; A63B 22/0025; A63B 22/0048; A63B 22/0056;
(Continued)

(56) References Cited

U.S. PATENT DOCUMENTS 5,040,785 A * 8/1991 Charnitski ..... A63B 22/001 482/51
5,492,515 A * 2/1996 Charnitski ..... A63B 22/001 482/37

(Continued)

*Primary Examiner* — Loan B Jimenez
*Assistant Examiner* — Catrina A Letterman
(74) *Attorney, Agent, or Firm* — Donald E. Stout; Stout, Uxa & Buyan, LLP

(57) ABSTRACT

A climbing machine includes a resistance device, a driving device, and two climbing devices. The driving device comprises an upper wheel set, an axial wheel set, and a lower wheel set. The axial wheel set includes a first axial wheel and a second axial wheel. Through a plurality of connecting members, the alternate up and down movements of the climbing device drive the upper wheel set and the lower wheel set to rotate in a first direction, the upper wheel set drives the first axial wheel to rotate in a second direction, and the lower wheel set drives the second axial wheel to rotate in the first direction.

8 Claims, 7 Drawing Sheets

(51) Int. Cl.
*A63B 22/00* (2006.01)
*A63B 21/22* (2006.01)

(52) U.S. Cl.
CPC ..... *A63B 21/154* (2013.01); *A63B 21/227* (2013.01); *A63B 21/4034* (2015.10); *A63B 22/0005* (2015.10); *A63B 22/0012* (2013.01)

(58) Field of Classification Search
CPC ..... A63B 22/0058; A63B 22/0061; A63B 22/0064; A63B 22/0066; A63B 22/0069; A63B 22/02; A63B 22/06; A63B 22/0605; A63B 22/0664; A63B 23/00; A63B 23/035; A63B 23/03508; A63B 23/03516; A63B 23/03525; A63B 23/03533; A63B 23/0355; A63B 23/03575; A63B 23/03583; A63B 23/03591; A63B 23/04; A63B 23/0405; A63B 23/0417; A63B 23/0423; A63B 23/0429; A63B 23/0458; A63B 23/0464; A63B 23/047; A63B 23/0476; A63B 23/08; A63B 23/12; A63B 21/00181; A63B 21/00178; A63B 2208/12; A63B 2208/0238; A63B 22/0046; A61H 1/0262; A61H 2201/164; A61H 2201/14; A61H 2201/1676; A61H 1/0255; A61H 2201/5007
See application file for complete search history.

(56) References Cited

U.S. PATENT DOCUMENTS

| | | | | |
|---|---|---|---|---|
| 2003/0013582 | A1* | 1/2003 | Anderson | A63B 22/205 482/52 |
| 2004/0204293 | A1* | 10/2004 | Andreasen | A63B 21/00178 482/52 |
| 2014/0248999 | A1* | 9/2014 | Lu | A63B 21/154 482/52 |
| 2019/0134456 | A1* | 5/2019 | Yeh | A63B 22/205 |
| 2019/0381349 | A1* | 12/2019 | Chen | A63B 21/4034 |

* cited by examiner

CLIMBING MACHINE

CROSS-REFERENCE TO RELATED APPLICATIONS

The entire contents of Taiwan Patent Application No. 107133633, filed on Sep. 25, 2018, to which this application claims priority, are expressly incorporated herein by reference.

BACKGROUND OF THE INVENTION

1. Field of the Invention

The present invention relates to an exercise machine, and more particularly relates to a climbing machine.

2. Description of Related Art

Climbing is a sport derived from mountaineering and is an activity of using one's hands, feet, or any other part of the body to ascend a steep object. Climbing can strengthen core muscles and has many benefits for the body.

US Published Patent No. 20170157445 discloses a "FLUID DISPLACEMENT STATIONARY EXERCISE EQUIPMENT WITH CONTINUOUSLY VARIABLE TRANSMISSION", the application of which includes a climbing machine 2. FIG. 2 illustrates how the force-resisting climbing device 2 works with the user foot plates 21. Two ends of a main shaft 29 penetrating the center of a main sprocket 20 are provided with a first sprocket 26 and a second sprocket 27 respectively. The foot plates 21 are coupled to chains 22 which are coupled to flexible cables 23 which are fed to front pulley 25 and then to chains 22 which are fed to sprocket 26 coupled to the main shaft 29 via an unidirectional clockwise clutch, and to sprocket 27 coupled to the main shaft 29 via an unidirectional counter clockwise clutch 28. The chains 22 are coupled to flexible cables 23 which travel around the rear pulleys 24. Such design is characterized in that the height of the main shaft 29 must be higher than that of the foot plate 21, and hence the foot plate 21 cannot be designed to have a large stroke (up and down moving distance). In addition, the chain 22 must be equipped with a steel cable (flexible cable 23), a front pulley 25, and a rear pulley 24 for steering, and the tolerance between the components must be precisely adjusted to operate smoothly.

Taiwan Patent No. 1618559 discloses a "climbing machine" having two pedals sliding up and down along two tracks. One connecting block is connected to each of the two pedals. A front chain is wound around the lower side of the two lower sprockets and the two ends of the front chain are connected to the connecting block. The two side chains are arranged on the upper side of the two upper sprockets with each side chain having one end connected to one connecting block. One steel rope is wound around the lower side of the fixed pulley with two ends coupled to the other ends of the two side chains, and a magnetic-controlled damping device is driven by the two upper sprocket wheels.

Taiwan Patent No. I621465B discloses a climbing machine comprising a base, a damping device, two climbing simulators, and two pedaling structures. The damping device is mounted on the base and has two sides with each connecting to a pedaling structure. The two climbing simulators are vertically disposed on both sides of the damping device. Each climbing simulator includes a track and a holding device being slidably disposed in the track and being connected to the corresponding pedaling structure through two connecting rods. In addition, a pulley is disposed above each track and engages with a belt, which includes two terminals with each connecting one holding device, so that the two holding devices are pulled with each other and are alternately moved up and down.

Taiwan Patent No. M549640U discloses a climbing mechanism comprising two upright rails, two sliding sets, a linkage mechanism, and a magnetic-controlled damping device. Each sliding set includes a slider, a handle, and a pedal. The slider is placed in the track with rollers on both sides to allow it to slide up and down within the track. The upper end of the slider is connected to the handle, and the lower end is connected to the pedal. The linkage mechanism has components such as a sprocket and a steel rope so that the two sliders can be pulled with each other. The magnetic-controlled damping device is coaxially coupled to the sprocket to provide the damping strength during training.

In summary, today's climbing machines mainly drive the pedals by a chain mechanism or a link mechanism. The chain mechanism drives the pedals by chains and sprockets, with steel cables and pulleys, and all sprockets circle around a same axle. To increase the stroke of the pedals, the whole sprocket set needs to be placed higher, which will increase the overall height of the climbing machine. In addition, the tolerance between the chains, steel cable, and the front and rear pulleys must be precisely adjusted to operate smoothly. This will increase the difficulty of product production and the failure probability. In addition, the coating material of the steel cable is prone to wear out after long-term use. In the latter case, the disadvantage of driving the pedal with the link mechanism is that the pedal operation has slow response when operated in short strokes.

SUMMARY OF THE INVENTION

In one general aspect, the present invention relates to a climbing machine with excellent reliability, quick response, and smooth operation.

According to an embodiment of this invention, a climbing machine is provided with a support frame, two climbing devices, a resistance device, and a driving device. The support frame comprises two uprights. The two climbing devices couples to the two uprights, and each of the two climbing device comprises a sliding tube for moving up and down along the corresponding upright. The resistance device comprises an axle for providing a resistance for the two climbing devices. The driving device comprises an axial wheel set, an upper wheel set, a lower wheel set, a first transmission member, a second transmission member, and a third transmission member. The axial wheel set comprises a first axial wheel and a second axial wheel, wherein the first axial wheel and the second axial wheel are pivotally coupled to the axle and are rotated independently to each other, and each of the first axial wheel and the second axial wheel comprises a one-way bearing. The upper wheel set is disposed above the axial wheel set. The lower wheel set is disposed below the axial wheel set. The first transmission member connects with the sliding tube of the two climbing device, the upper wheel set, and the first axial wheel. The second transmission member connects the sliding tube of the two climbing device and the lower wheel set. The third transmission member connects the second axial wheel and the lower wheel set. Whereby the alternate up and down movements of the sliding tube of the two climbing devices causes the upper wheel set and the lower wheel set to rotate in a first direction, the first axial wheel to rotate in a second direction, and the second axial wheel to rotate in the first direction.

In one embodiment, the upper wheel set comprises a first sprocket and a second sprocket, and the lower wheel set comprises a third sprocket and a fourth sprocket, and wherein the third sprocket is a double sprocket comprising a sprocket A and a sprocket B, the first transmission member, the second transmission member, and the third transmission member are chains, and the first axial wheel and the second axial wheel are sprockets.

In one embodiment, the first transmission member engages with the first sprocket, the second sprocket, and the first axial wheel and includes two ends coupled with the two sliding tubes of the two climbing devices, the second transmission member engages with the sprocket A of the third sprocket and the fourth sprocket and includes two ends coupled with the two sliding tubes of the two climbing devices, and the third transmission member engages with the sprocket B of the third sprocket and the second axial wheel.

In one embodiment, each climbing device further comprises a pedal and a pedal support, wherein the sliding tube is movably disposed within the upright, a portion of the pedal support is movably disposed within a slot of the upright, and the pedal connects to the pedal support.

In one embodiment, the upper wheel set comprises a first timing pulley and a second timing pulley, the lower wheel set comprises a third timing pulley and a fourth timing pulley, and wherein the third timing pulley is a double timing pulley comprising a timing pulley A and a timing pulley B, the first transmission member, the second transmission member, and the third transmission member are timing belts, and the first axial wheel and the second axial wheel are timing pulleys.

In one embodiment, the first transmission member engages with the first timing pulley, the second timing pulley, and the first axial wheel and includes two ends coupled with the two sliding tubes of the two climbing devices, the second transmission member engages with the timing pulley A of the third timing pulley and the fourth timing pulley and includes two ends coupled with the two sliding tubes of the two climbing devices, and the third transmission member engages with the timing pulley B of the third timing pulley and the second axial wheel.

In one embodiment, each climbing device further comprises a plurality of adjusting wheel sets, and each of the plurality of adjusting wheel sets comprises a plurality of fixed wheels configured to abut an outer surface of the sliding tube. In one embodiment, each adjusting wheel set comprises two fixed wheels, two adjusting wheels, and an adjusting device. The two fixed wheels are pivotally mounted on a fixing seat at a side of the upright and are in contact with outer surface of the sliding tube. The two adjusting wheels are disposed on the upright opposite to the two fixed wheels. The adjusting device couples to the two adjusting wheels for adjusting tightness between the two adjusting wheels and the sliding tube.

In one embodiment, the adjusting device comprises an adjusting member and an adjusting bolt. The adjusting member is pivotally mounted on a raised structure protruded from surface of the upright. The adjusting bolt passes through a first end of the adjusting member and connecting to the upright. The two adjusting wheels are pivotally mounted on a left side and a right side of a second end of the adjusting member and abut against the outer surface of the sliding tube.

In one embodiment, the resistance device comprises a driving wheel having the axle, and a flywheel coupling to the driving wheel via a connecting member.

The climbing machines provided by the present invention can avoid the transmission failure caused by the adjustment error between the two different transmission components, and avoid wear out of the coating material of the steel cable after long-term operation. In addition, the climbing machine can be designed to have a large stroke with advantages of smooth operation and quick response.

DETAILED DESCRIPTION OF THE PREFERRED EMBODIMENT

Figure 1:
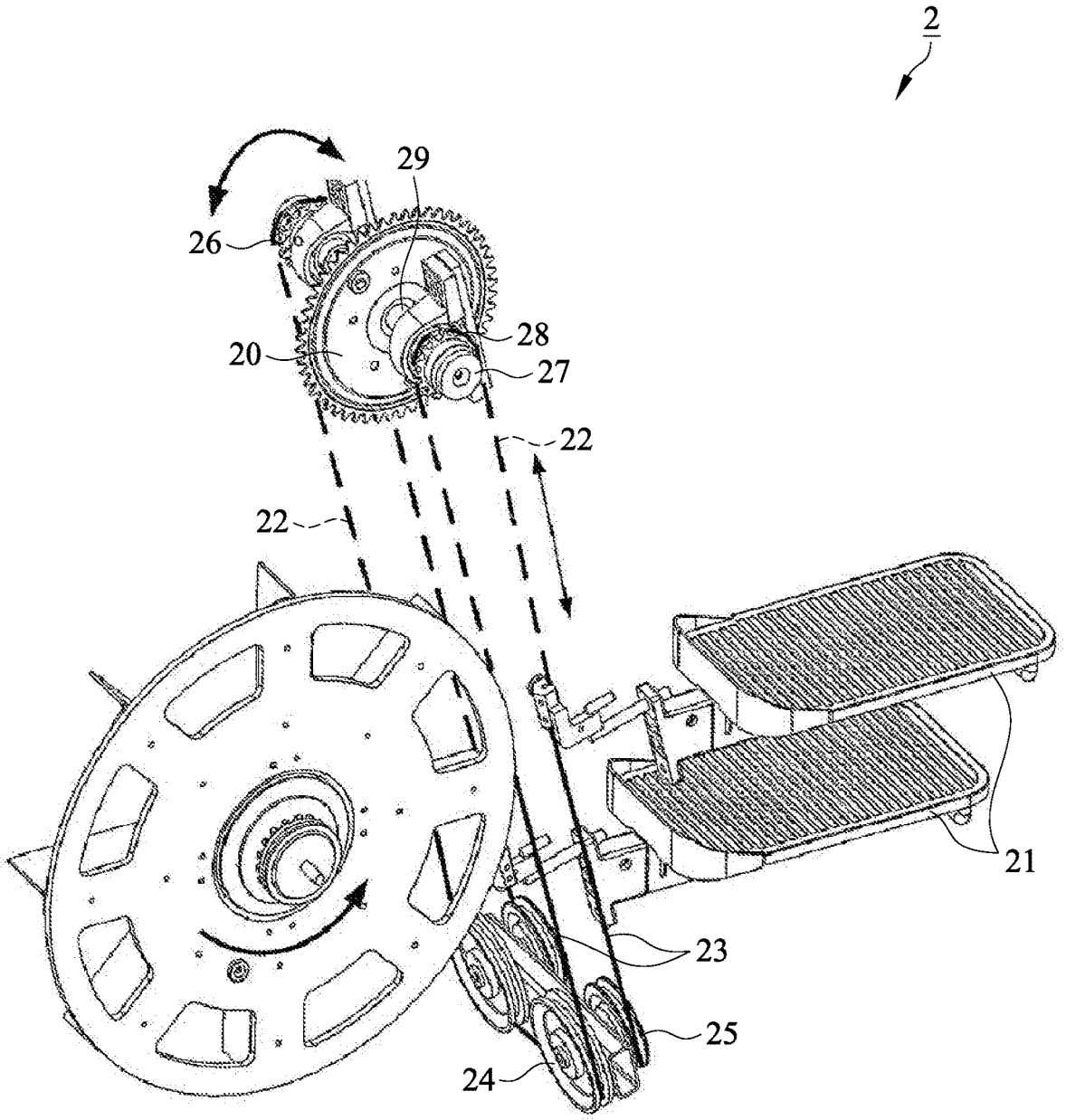
FIG. 1 (prior art)
FIG. 1 illustrates a driving mechanism of a conventional climbing machine.

Embodiments of the invention are now described and illustrated in the accompanying drawings, instances of which are to be interpreted to be to scale in some implementations while in other implementations, for each instance, not. In certain aspects, use of like or the same reference designators in the drawings and description refers to the same, similar or analogous components and/or elements, while according to other implementations the same use should not. According to certain implementations, use of directional terms, such as, top, bottom, left, right, up, down, over, above, below, beneath, rear, front, clockwise, and counterclockwise, are to be construed literally, while in other implementations the same use should not. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components.

Figure 2:
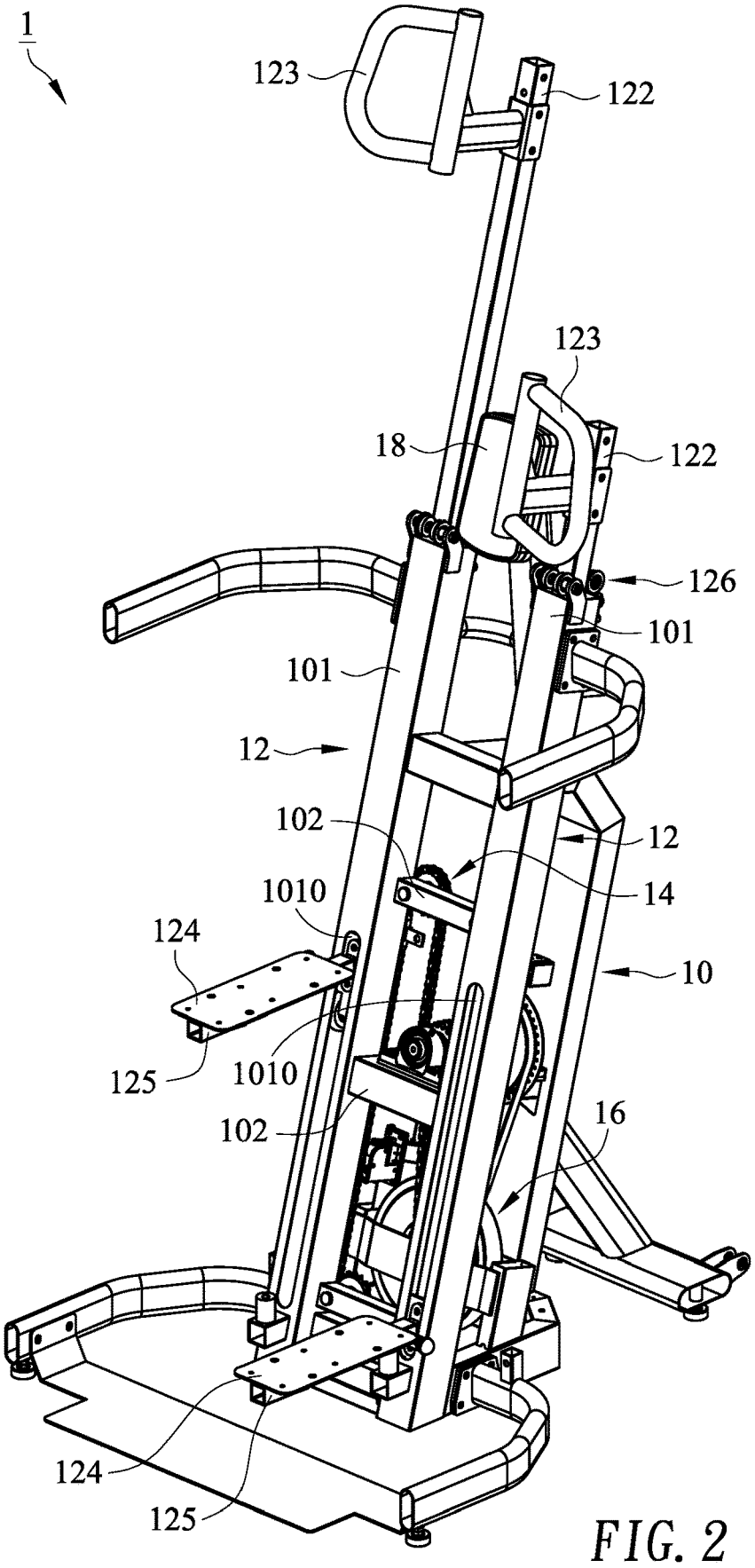
FIG. 2 is a perspective view showing a climbing machine according to a preferred embodiment of the present invention.

FIG. 2 is a perspective view of a climbing machine 1 provided by a preferred embodiment of the present invention. As shown in FIG. 2, the climbing machine 1 mainly includes a support frame 10, two climbing devices 12, a driving device 14, and a resistance device 16. The two climbing devices 12 are coupled to the support frame 10 allowing for the user to simulate climbing. The resistance device 16 provides resistance to climbing. The driving device 14 connects the two climbing devices 12 and the resistance device 16. The details are explained below.

Figure 3:
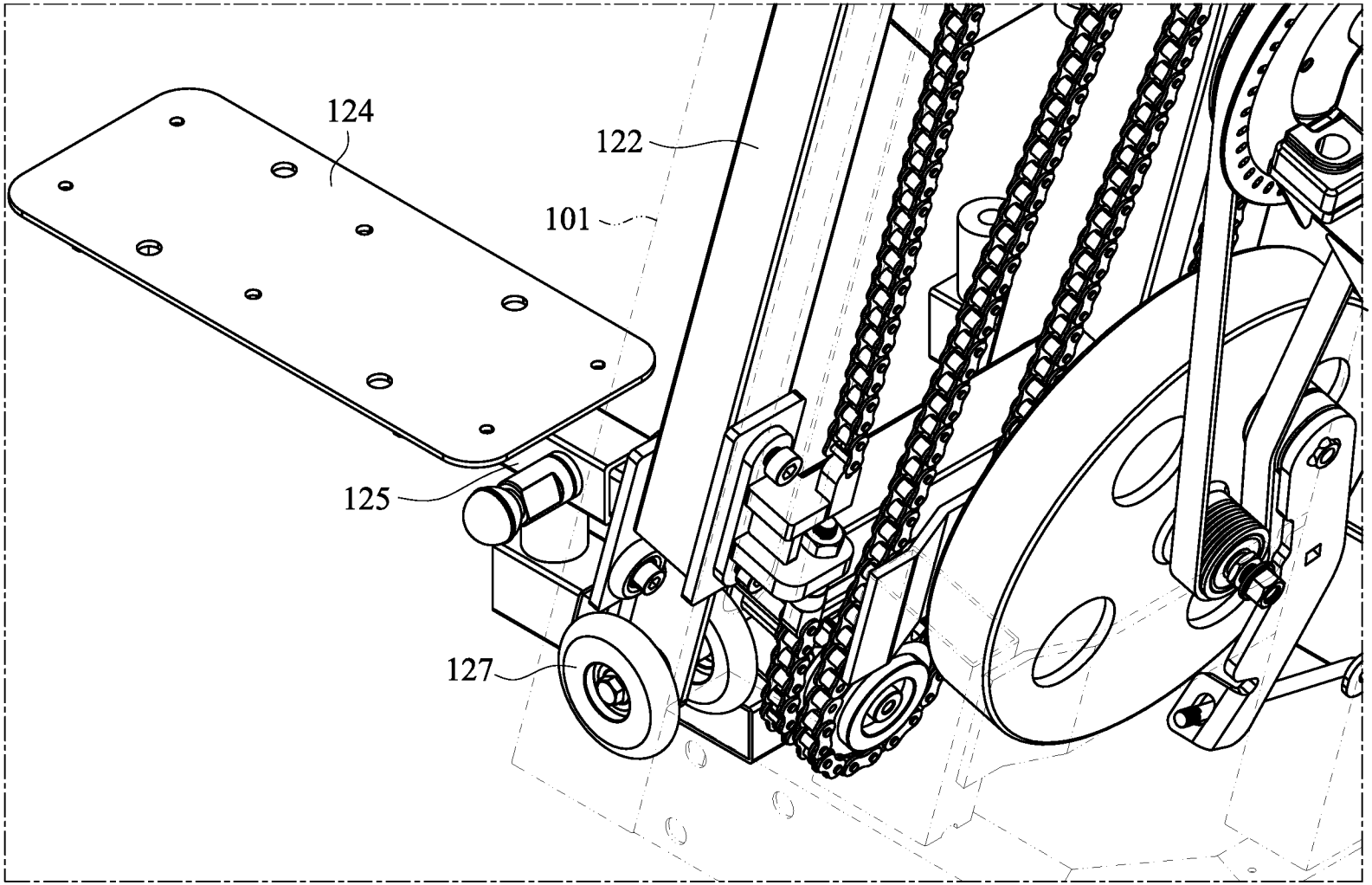
FIG. 3 is a partially perspective view showing the climbing machine according to the preferred embodiment of the present invention.

FIG. 3 is a partially perspective view of the climbing machine 1 provided in accordance with the preferred embodiment of the present invention, wherein portions of the structure or some elements are omitted and not shown to highlight the features of the climbing machine 1. As shown in FIGS. 2 and 3, the support frame 10 may have two hollow uprights 101 and several horizontal bars 102 arranged between the two uprights 101. Each climbing device 12 has a sliding tube 122, a handle 123, and a pedal 124. Each of the sliding tubes 122 is slidably disposed in the corresponding upright 101. The upper end of the sliding tube 122 is fixed to the handle 123, and the lower end of the sliding tube 123 is fixed to the pedal support 125, which is coupled to the pedal 124. As shown in FIG. 3, each climbing device 12 may further have two pulleys 127 disposed on both sides of the lower end of the sliding tube 122, and the pulley 127 abuts against the inner wall of the upright 101. The lower half of the upright 101 has a longitudinal slot 1010, and a portion of the pedal support 125 is located within the slot 1010. As the sliding tube 122 slides up and down within the upright 101, the pedal support 125 moves up and down along the slot 1010. The user's hands grip the handles 123 and the feet are stepped on the pedal 124 to simulate climbing training.

Figure 4:
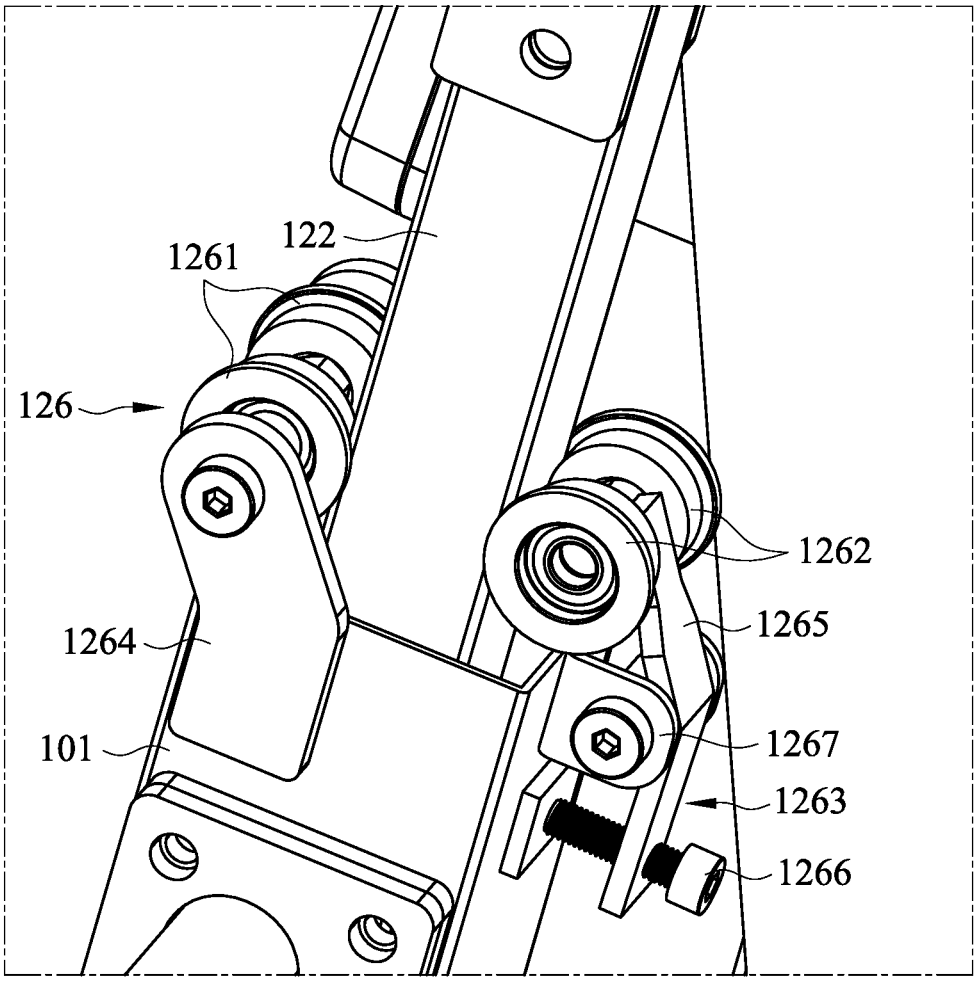
FIG. 4 is a partially perspective view showing the climbing machine according to the preferred embodiment of the present invention.

FIG. 4 is a partially perspective view of the climbing machine 1 in accordance with the preferred embodiment of the present invention. As shown in FIG. 4, each climbing device 12 can further include one or more adjusting wheel sets 126. As shown in FIG. 4, each adjusting wheel set 126 includes two fixed wheels 1261, two adjusting wheels 1262, and an adjusting device 1263. In the present embodiment, the two fixed wheels 1261 are axially disposed on the fixing seat 1264 on one side of the upright 101 and abut against the outer surface of the sliding tube 122. The adjusting device 1263 is disposed on the opposite side of the fixed wheel 1261. The adjusting device 1263 has an adjusting member 1265 and an adjusting bolt 1266. The adjusting member 1265 is pivotally disposed on a raised structure 1267 on a side of the upright 101. The adjusting bolt 1266 passes through the lower end of the adjusting member 1265 and is connected to the upright 101. The two adjusting wheels 1262 are axially disposed on the left and right side of the upper end of the adjusting member 1265 and abut against the outer surface of the sliding tube 122. Thereby, the degree of tightness between the adjusting wheel 1262 and the sliding tube 122 can be adjusted by rotating the adjusting bolt 1266. The adjusting wheel set 126 is rotatably coupled between the upright 101 and the sliding tube 122 to maintain the sliding tube 122 in position and to reduce friction between the sliding tube 122 and the upright 101.

Figure 5:
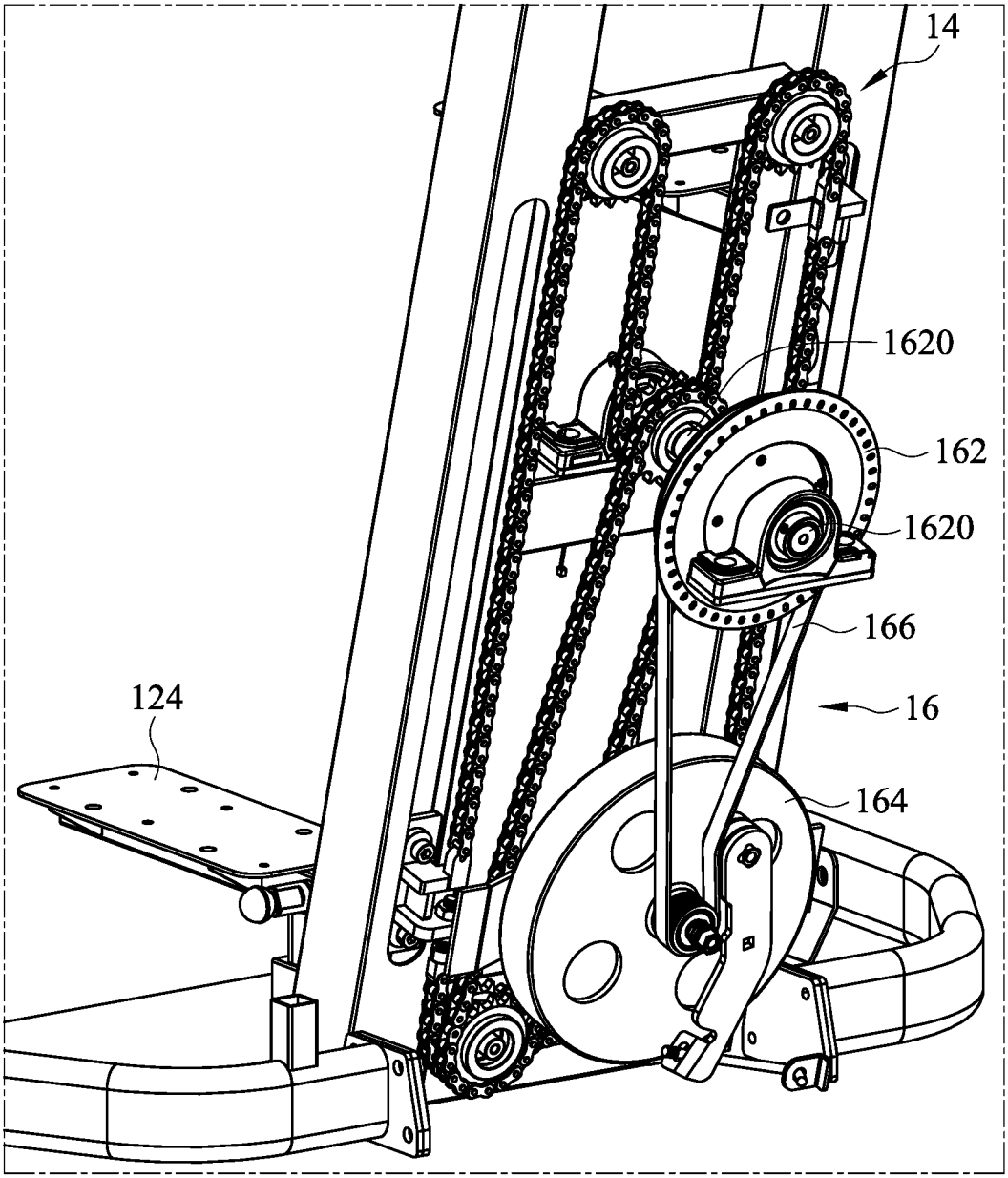
FIG. 5 is a partially perspective view showing the climbing machine according to the preferred embodiment of the present invention.

FIG. 5 is a partially perspective view of the climbing machine 1 provided in accordance with the preferred embodiment of the present invention, wherein portions of the structure or some elements are not shown to highlight features of the climbing machine 1. Referring to FIGS. 1-5, the resistance device 16 is coupled to the climbing device 12 via the driving device 14 to provide a resistance for the user. The resistance can be controlled through the operating interface 18 disposed above the support frame 10. In the preferred embodiment, the resistance device 16 can include, but is not limited to, a driving wheel 162, a flywheel 164, and a connecting member 166. The user's alternate stepping operation drives the driving wheel 162 via the driving device 14, and the driving wheel 162 drives the flywheel 164 to rotate through a connecting member 166, such as a belt.

Figure 6:
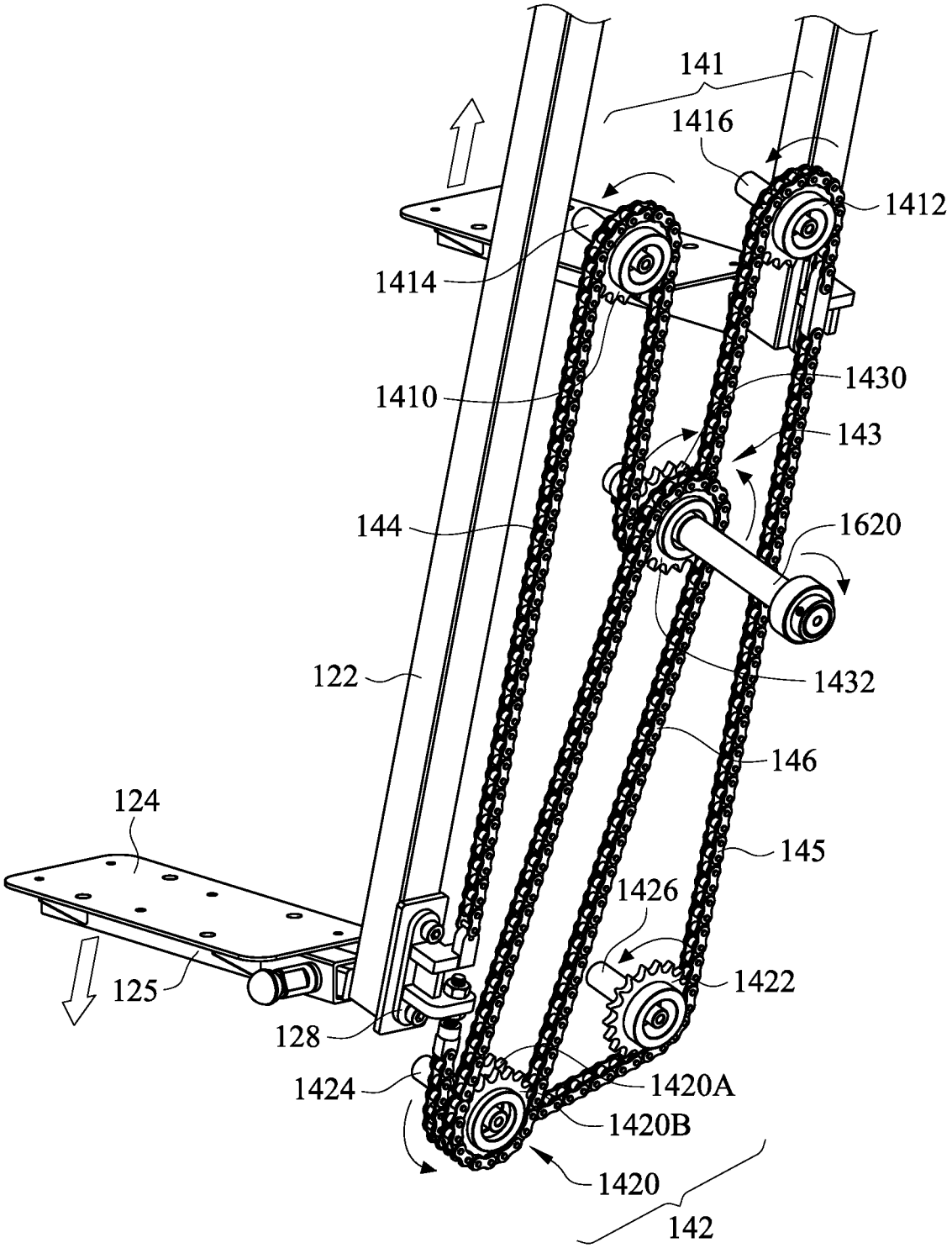
FIG. 6 is a partially perspective view showing the climbing machine according to the preferred embodiment of the present invention.
Figure 7:
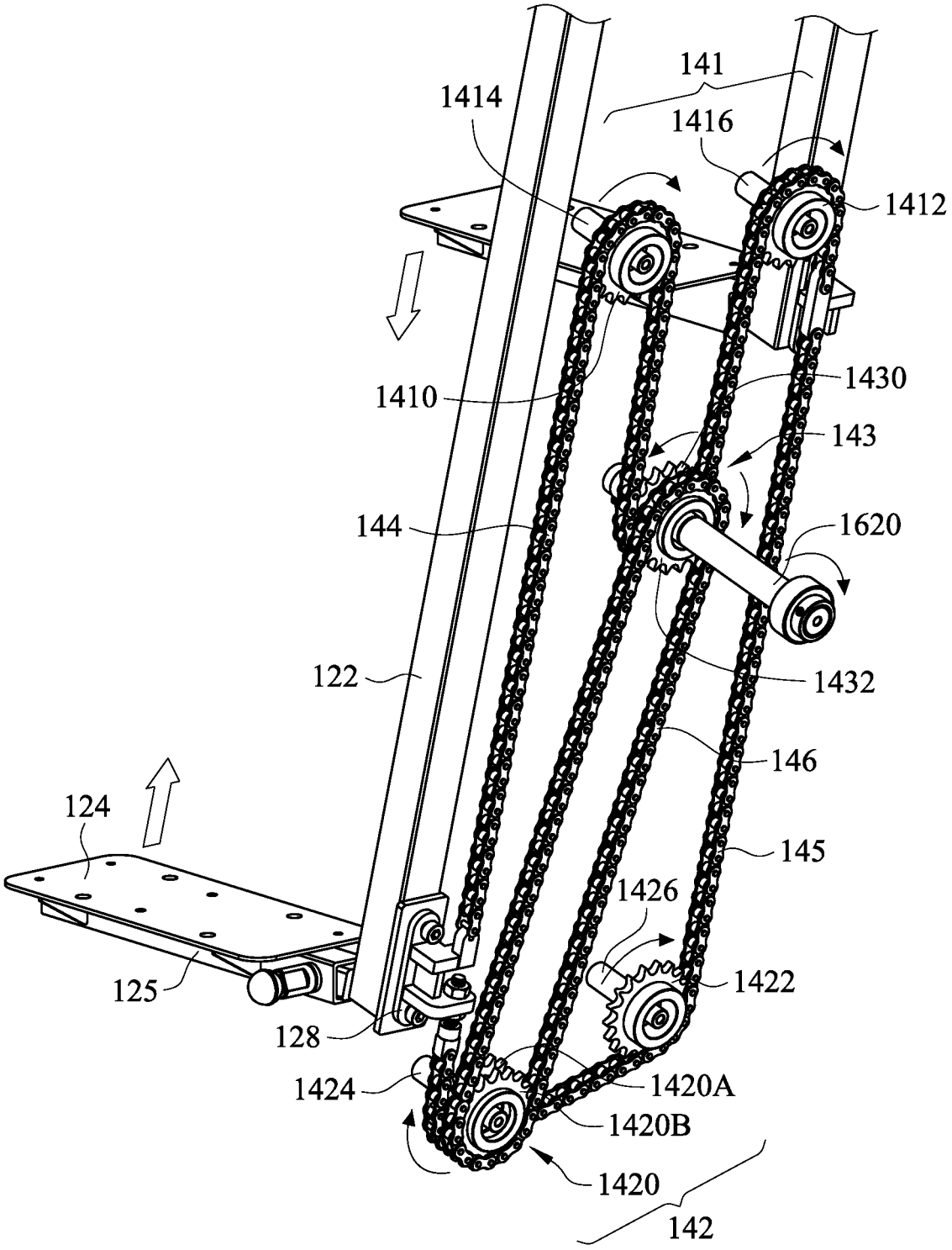
FIG. 7 is a partially perspective view showing the climbing machine according to the preferred embodiment of the present invention.

FIGS. 6 and 7 are partially perspective views of the climbing machine 1 provided by the preferred embodiment of the present invention, wherein portions of the structure or some elements are omitted and not shown to highlight the features of the climbing machine 1. Referring to FIGS. 1-7, the driving device 14 includes an upper wheel set 141, a lower wheel set 142, an axial wheel set 143, a first transmission member 144, a second transmission member 145, and a third transmission member 146. The upper wheel set 141 is located above the axial wheel set 143 and the lower wheel set 142 is located below the axial wheel set 143.

Referring to FIGS. 6-7, the axial wheel set 143 includes a first axial wheel 1430 and a second axial wheel 1432. The first axial wheel 1430 and the second axial wheel 1432 are pivotally disposed on the axle 1620 of the driving wheel 162, but the rotation of the two is independent to each other and the directions of rotation are opposite. In addition, each of the first axial wheel 1430 and the second axial wheel 1432 includes a one-way bearing (not shown), and the two one-way bearings cause the axle 1620 to rotate in one predetermined direction, such as clockwise or counterclockwise direction.

Referring to FIGS. 6-7, the first transmission member 144 connects the two sliding tubes 122, the upper wheel set 141, and the first axial wheel 1430 of the axial wheel set 143, and the alternate up and down movements of the sliding tube 122 will cause the upper wheel set 141 to rotate in a first direction and cause the first axial wheel 1430 to rotate in a second direction. The second transmission member 145 connects the two sliding tubes 122 and the lower wheel set 142. The third transmission member 146 connects the lower wheel set 142 and the second axial wheel 1432 of the axial wheel set 143. The alternate up and down movements of the sliding tube 122 will cause the lower wheel set 142 to rotate in the first direction and cause the second axial wheel 1432 to also rotate in the first direction.

Referring to FIGS. 6-7, in this embodiment, the upper wheel set 141 includes a first sprocket 1410 and a second sprocket 1412. The lower wheel set 142 includes a third sprocket 1420 and a fourth sprocket 1422. The first transmission member 144, the second transmission member 145, and the third transmission member 146 are all chains. Both the first axial wheel 1430 and the second axial wheel 1432 are sprocket wheels.

Referring to FIGS. 6-7, in this embodiment, the first sprocket 1410, the second sprocket 1412, the third sprocket 1420, and the fourth sprocket 1422 are connected to the plurality of horizontal bars 102 of the support frame 10 via a first axle 1414, a second axle 1416, a third axle 1424, and a fourth axle 1426, respectively. In another embodiment, the first sprocket 1410, the second sprocket 1412, the third sprocket 1420, and the fourth sprocket 1422 are connected to the two uprights 101, or, in another embodiment, connected to one or two of the uprights 101 and/or the horizontal bars 102. The first sprocket 1410, the second sprocket 1412, the third sprocket 1420, and the fourth sprocket 1422 rotate respectively around the first axle 1414, the second axle 1416, the third axle 1424, and the fourth axle 1426.

Referring to FIG. 6, in the present embodiment, the third sprocket 1420 is a double sprocket comprising two synchronous, co-rotating A sprocket 1420A and B sprocket 1420B. In another embodiment of the invention, the positions of the third sprocket 1420 and the fourth sprocket 1422 are interchanged (i.e., the fourth sprocket, instead of the third sprocket, is a double sprocket).

Referring to FIG. 6, in the present embodiment, the lower end of each sliding tube 122 is fixed to a connecting structure 128. Both ends of the first transmission member 144 are connected to the upper ends of the two connection structures 128, and the first transmission member 144 engages with the first sprocket 1410, the second sprocket 1412, and the first axial wheel 1430. Both ends of the second transmission member 145 are connected to lower ends of the two connecting structures 128, and the second transmission member 145 engages with the fourth sprocket 1422 and the A sprocket 1420A of the third sprocket 1420. The third transmission member 146 is annularly closed and engages with the B sprocket 1420B of the third sprocket 1420 and the second axial wheel 1432.

Referring to FIG. 6, when the two pedals 124 move up and down, for example, when the pedal 124 at the left side is downward and the pedal 124 at the right side is up, the first sprocket 1410, the second sprocket 1412, the third sprocket 1420, and the fourth sprocket 1422 rotate counterclockwise, the first axial wheel 1430 rotates clockwise, and the second axial wheel 1432 is driven counterclockwise by the third sprocket 1420. At this time, the one-way bearing in the second axial wheel 1432 is loosened from the axle 1620, the one-way bearing in the first axial wheel 1430 is engaged with the axle 1620, and the kinetic energy is transmitted from the first axial wheel 1430 to the axle 1620 of the driving wheel 162.

Referring to FIG. 7, when the two pedals 124 move up and down, for example, when the pedal 124 at the left side is up and the pedal 124 at the right side is downward, the first sprocket 1410, the second sprocket 1412, the third sprocket 1420, and the fourth sprocket 1422 rotate clockwise, the first axial wheel 1430 rotates counterclockwise, and the second axial wheel 1432 is driven clockwise by the third sprocket 1420. At this time, the one-way bearing in the first axial wheel 1430 is loosened from the axle 1620, the one-way bearing in the second axial wheel 1432 is engaged with the axle 1620, and the kinetic energy is transmitted from the second axial wheel 1432 to the axle 1620 of the driving wheel 162.

The climbing machine 1 provided by the embodiment of the invention only employs the sprockets and chains, no need with pulleys and steel cables: This can avoid the transmission failure caused by the adjustment error between the two different transmission components, and wear out of the coating material of the steel cable after long-term operation. Further, according to the climbing machine 1 of the embodiment of the present invention, since the first sprocket 1410 and the second sprocket 1412 are not the same axle as the driving wheel 162, and the position of the axle 1620 can be lower than the pedal 124, it can be designed such that the pedals 124 have a large stroke (up and down movement distance). For example, by placing the first sprocket 1410 and the second sprocket 1412 in a higher position with a longer length of the slot 1010, the pedal 124 will have a larger stroke. In addition, the climbing machine 1 provided by the embodiment of the invention has the advantages of smooth operation and fast response.

Various modifications and equivalent changes may be made to the above embodiments. For example, in another embodiment of the present invention, the first transmission member 144, the second transmission member 145, and the third transmission member 146 are all changed to corresponding timing belts, and the first sprocket 1410, the second sprocket 1412, the third sprocket 1420, the fourth sprocket 1422, the first axial wheel 1430, and the second axial wheel 1432 are all changed to the corresponding timing pulleys. The first transmission member 144 is changed to a timing belt having teeth on both sides, and the remaining transmission members are replaced with a timing belt having teeth on one side. The third sprocket 1420 is replaced with a double timing pulley, which includes timing pulley A and timing pulley B rotating in the same direction. Each timing pulley is toothed to engage with teeth of a timing belt. The working principle and other details of the embodiment are the same as the foregoing embodiment and are omitted for simplicity.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

All of the contents of the preceding documents are incorporated herein by reference in their entireties. Although the disclosure herein refers to certain illustrated embodiments, it is to be understood that these embodiments have been presented by way of example rather than limitation. For example, any of the particulars or features set out or referenced herein, or other features, including method steps and techniques, may be used with any other structure(s) and process described or referenced herein, in whole or in part, in any combination or permutation as a non-equivalent, separate, non-interchangeable aspect of this invention. Corresponding or related structure and methods specifically contemplated and disclosed herein as part of this invention, to the extent not mutually inconsistent as will be apparent from the context, this specification, and the knowledge of one skilled in the art, including, modifications thereto, which may be, in whole or in part, (i) operable and/or constructed with, (ii) modified by one skilled in the art to be operable and/or constructed with, and/or (iii) implemented/made/ used with or in combination with, any parts of the present invention according to this disclosure, include: (I) any one or more parts of the above disclosed or referenced structure and methods and/or (II) subject matter of any one or more of the inventive concepts set forth herein and parts thereof, in any permutation and/or combination, include the subject matter of any one or more of the mentioned features and aspects, in any permutation and/or combination.

Although specific embodiments have been illustrated and described, it will be appreciated by those skilled in the art that various modifications may be made without departing from the scope of the present invention, which is intended to be limited solely by the appended claims.

What is claimed is:

1. A climbing machine, comprising:

a support frame comprising two uprights;

two climbing devices coupling the two uprights, each of the two climbing device comprising a sliding tube for moving up and down along the corresponding upright;

a resistance device comprising an axle for providing a resistance for the two climbing devices;

a driving device, comprising:

an axial wheel set comprising a first axial wheel and a second axial wheel, wherein the first axial wheel and the second axial wheel are pivotally coupled to the axle and are rotated independently to each other, and each of the first axial wheel and the second axial wheel comprises a one-way bearing;

an upper wheel set disposed above the axial wheel set;

a lower wheel set disposed below the axial wheel set;

a first transmission member connecting the sliding tubes of the two climbing devices, the upper wheel set, and the first axial wheel;

a second transmission member connecting the sliding tubes of the two climbing devices and the lower wheel set;

a third transmission member connecting the second axial wheel and the lower wheel set;

whereby the alternate up and down movements of the sliding tube of the two climbing devices cause the upper wheel set and the lower wheel set to rotate in a first direction, the first axial wheel to rotate in a second direction, and the second axial wheel to rotate in the first direction.

2. The climbing machine as recited in claim 1, wherein the upper wheel set comprises a first sprocket and a second sprocket, the lower wheel set comprises a third sprocket and a fourth sprocket, and wherein the third sprocket is a double sprocket comprising a sprocket A and a sprocket B, the first transmission member, the second transmission member, and the third transmission member are chains, and the first axial wheel and the second axial wheel are sprockets.

3. The climbing machine as recited in claim 2, wherein the first transmission member engages with the first sprocket, the second sprocket, and the first axial wheel and includes two ends coupled with the two sliding tubes of the two climbing devices, the second transmission member engages with the sprocket A of the third sprocket and the fourth sprocket and includes two ends coupled with the two sliding tubes of the two climbing devices, and the third transmission member engages with the sprocket B of the third sprocket and the second axial wheel.

4. The climbing machine as recited in claim 1, wherein each of the two climbing devices further comprises a pedal and a pedal support, the sliding tube is movably disposed within the upright, a portion of the pedal support is movably disposed within a slot of the upright, and the pedal connects to the pedal support.

5. The climbing machine as recited in claim 1, wherein each of the two climbing devices further comprises a plurality of adjusting wheel sets, and each of the plurality of adjusting wheel sets comprises a plurality of fixed wheels configured to abut an outer surface of the sliding tube.

6. The climbing machine as recited in claim 5, wherein each adjusting wheel set comprises:

two fixed wheels being pivotally mounted on a fixing seat at a side of the upright and being in contact with an outer surface of the sliding tube;

two adjusting wheels being disposed on the upright opposite to the two fixed wheels; and an adjusting device coupling to the two adjusting wheels for adjusting tightness between the two adjusting wheels and the sliding tube.

7. The climbing machine as recited in claim 6, wherein the adjusting device comprises:

an adjusting member being pivotally mounted on a raised structure protruded from a surface of the upright; and an adjusting bolt passing through a first end of the adjusting member and connecting to the upright, the two adjusting wheels being pivotally mounted on a left side and a right side of a second end of the adjusting member and abutting against the outer surface of the sliding tube.

8. The climbing machine as recited in claim 1, wherein the resistance device further comprises:

a driving wheel having the axle; and a flywheel coupling to the driving wheel via a connecting member.

* * * * *